United States Patent [19]

Grecksch et al.

[11] Patent Number: 4,878,629

[45] Date of Patent: Nov. 7, 1989

[54] RESERVE WINDING OF YARN ON A TUBE OF A CROSS-WOUND BOBBIN AND METHOD AND APPARTUS OF FORMING SAME

[75] Inventors: Hans Grecksch, Monchengladbach; Josef Bertrams, Wegberg; Rene Bucken, Grefrath, all of Fed. Rep. of Germany

[73] Assignee: W. Schlafhorst & Co., Fed. Rep. of Germany

[21] Appl. No.: 208,145

[22] Filed: Jun. 16, 1988

[30] Foreign Application Priority Data

Jun. 17, 1987 [DE] Fed. Rep. of Germany ..... 3720220
Oct. 2, 1987 [DE] Fed. Rep. of Germany ..... 3733353

[51] Int. Cl.[4] ..... B65H 54/02; B65H 54/34

[52] U.S. Cl. ..... 242/18 PW; 242/35.5 A; 242/164; 242/165

[58] Field of Search ..... 242/18 PW, 18 DD, 18 A, 242/35.5 A, 164, 165

[56] References Cited

U.S. PATENT DOCUMENTS

| | | | |
|---|---|---|---|
| 1,477,162 | 12/1923 | Andrew | 242/165 |
| 2,429,330 | 10/1947 | Roberts . | |
| 3,823,884 | 7/1974 | Sartori | 242/18 PW |
| 3,858,816 | 1/1975 | Corbiere | 242/18 PW |
| 4,019,690 | 4/1977 | Peter et al. | 242/18 PW |
| 4,093,135 | 6/1978 | Hermanns | 242/18 PW |
| 4,154,409 | 5/1979 | Reisser et al. | 242/18 PW |
| 4,256,272 | 3/1981 | Reisser et al. | 242/18 PW |
| 4,662,574 | 5/1987 | Slavik et al. | 242/18 PW |
| 4,687,148 | 8/1987 | Schuller et al. | 242/18 PW |
| 4,739,940 | 4/1988 | Flueli et al. . | |

FOREIGN PATENT DOCUMENTS

| | | |
|---|---|---|
| 2445182 | 4/1976 | Fed. Rep. of Germany . |
| 2547519 | 5/1976 | Fed. Rep. of Germany . |
| 3344645 | 6/1985 | Fed. Rep. of Germany . |
| 3607342 | 9/1987 | Fed. Rep. of Germany . |
| 595274 | 2/1978 | Switzerland . |

OTHER PUBLICATIONS

Abstract of Japanese Patent Document No. 60-112569 dated June 19, 1985.

*Primary Examiner*—Stanley N. Gilreath
*Attorney, Agent, or Firm*—Shefte, Pinckney & Sawyer

[57] ABSTRACT

A reserve winding of yarn on a tube on which a cross-wound package is built. The reserve includes an end projecting from the windings and extending to provide an initial length along the surface of the tube and around which windings are formed without substantial overlapping with the windings progressing from the inward extent of the initial length of yarn toward the tube end. The reserve winding is formed by a method utilizing an apparatus that is part of a traveling service unit and includes a suction conduit centrally located in a tube clamping plate for drawing-in the end of yarn and yarn guiding and advancing elements that guide the yarn inwardly along the surface of the tube and then advance the yarn outwardly during rotation of the tube to form the non-overlapping windings. The drawn-in end of the yarn is then cut at a maximum of approximately one centimeter from the windings or is inserted into the interior of the tube.

13 Claims, 4 Drawing Sheets

RESERVE WINDING OF YARN ON A TUBE OF A CROSS-WOUND BOBBIN AND METHOD AND APPARTUS OF FORMING SAME

BACKGROUND OF THE INVENTION

The present invention relates to a reserve winding of yarn on a tube of a cross-wound bobbin and method and apparatus of forming same, and more particularly to a reserve winding, method and apparatus wherein the formed reserve winding is different from the cross-winding and retains the yarn end in place during cross-winding and subsequent unwinding of the cross-wound package of yarn.

It is known in the art that reserve windings of yarn can be formed on cone winders by positioning the yarn end from a supplied bobbin into the creel as a chord between the end of the winding tube and the tube plate against which the winding tube is clamped and then winding yarn on the winding tube adjacent the end and over the ends of the chord, forming several layers of reserve winding. These prior art reserve windings are not precisely controlled and it is not unusual that the yarn chord is not firmly fixed on the tube and becomes loose, which can result in the loss of the entire reserve winding. Furthermore, the reserve windings sometimes are wound on the ends of the yarn chord in a manner that it is not possible after the cross-wound package has been built, to identify the end of the chord to which the reserve yarn is connected, such that when it is attempted to draw off the reserve yarn, the chord is torn from the reserve yarn.

With the prior art chord disposition, there is also the possibility during high speed winding with frequent braking that the yarn chord will wear through at the edge of the tube, which results in a loose piece of yarn that can be picked up in the yarn processing, causing subsequent yarn breaks, fabric imperfections and other problems.

It should also be noted that even with proper reserve winding formation, the reserve windings may be difficult to remove.

SUMMARY OF THE INVENTION

In contrast to the prior art, the present invention provides a reserve winding of yarn on a tube of a cross-wound bobbin and a method and apparatus of forming same wherein the reserve windings can be easily and simply produced with reproduceable quality and wherein the end of the reserve winding yarn is readily accessible and the reserve windings can be removed simply and reliably.

Briefly described, the reserve winding of the present invention includes an initial length of yarn having an end accessible at the end of the tube and extending inwardly therefrom along the surface of the tube. A plurality of substantially non-overlapping windings progress from the inward extent of the initial length toward the end of the tube and overlay the initial length. This arrangement of the windings without overlapping results in the winding being readily removed later without interference problems and without creating high tensions and possible yarn breakage. Further, the windings are removed in sequence such that the last winding to be unwound provides retention. Preferably, the non-overlapping windings are slightly spaced apart to further assure ease of removal.

In one form of the preferred form of the invention the end of the initial length of yarn extends a maximum of approximately one centimeter beyond the plurality of windings so that it extends only slightly over the end of the tube and, therefore, is not easily destroyed or damaged. This short length substantially assures the yarn end being subsequently clamped between the tube end and a tube clamping plate in subsequent processing procedures.

In an alternate preferred embodiment the initial length of yarn extends over the end of the tube and into the tube to the extent of at least a few centimeters, where the yarn end is safely stored and readily engageable automatically by means of vacuum or blowing during subsequent processing. With this form there is still a disadvantage of possible damage or severing of the yarn end between the end of the tube and a tube clamping plate, but the yarn end is easily accessible and any loose piece of yarn caused by severing is on the inside of the tube and not readily available to be wound into the yarn being processed.

According to the method of the present invention, a reserve winding of yarn is formed on a tube on which the yarn is to be cross-wound to build a bobbin. The method includes drawing at least a few centimeters of yarn centrally into a rotatable tube plate, clamping the end of a tube against the tube plate with the yarn clamp therebetween, guiding the yarn inwardly from the clamped tube end along the surface of the tube to form an initial length of yarn, and rotating the tube and advancing the yarn toward the tube end to form a plurality of substantially nonoverlapping windings progressing toward the tube end and overlaying the initial length of yarn. Preferably the drawing of yarn is performed by suction in a central suction conduit in the tube plate.

The drawing of the yarn centrally into the tube plate advantageously prevents the formation of a chord of yarn across the bottom of the tube with the resulting disadvantages discussed above. Also, initial cross-winding of the package buildup can be applied to initially retain the reserve windings on the tube.

In one preferred form of the method of the present invention the drawn-in yarn is cut after the plurality of windings is formed to provide the aforementioned maximum length of the yarn of approximately one centimeter extending from the plurality of windings. Preferably this cutting occurs subsequent to unclamping of the tube from the tube plate.

In an alternate preferred form of the method of the present invention the drawing draws in at least a few centimeters of yarn, which is subsequently inserted into the interior of the tube mentioned above in regard to the alternate embodiment of the reserve winding of the present invention. The inserting of the drawn-in yarn into the interior of the tube is preferably performed by first sucking the yarn end into a central suction conduit in the tube plate and inserting the yarn end into the tube by blowing through the suction conduit into the interior of the tube.

According to the apparatus for forming a reserve winding according to the present invention, means are provided for drawing yarn centrally into a rotatable tube plate. Means are provided for clamping the end of a tube against the tube plate with the yarn clamped therebetween. Guiding means guide the yarn inwardly from the clamped tube end along the surface of the tube to form an initial length of yarn. Means are provided for rotating the tube and the tube plate in cooperation with means for advancing the yarn toward the tube end to form a plurality of substantially non-overlapping windings progressing toward the tube end and overlaying the initial length of yarn. Thus, the apparatus produces the above discussed reserve winding with practicing of the above described method.

Preferably, the apparatus includes an other tube plate, with the clamping means providing for shifting at least one of the tube plates relative to the other for clamping of the tube therebetween. Also preferably, the apparatus includes means for counting the rotation of the tube and controlling the rotating means in response to the counting so that upon counting of a preselected number of windings the rotation will be stopped.

To provide the above described maximum length of approximately one centimeter extending from the plurality of windings, the apparatus preferably includes means for cutting the drawn-in yarn.

The aforementioned drawing means preferably includes a central suction conduit in the tube plate and means for creating suction in the conduit to draw the yarn thereinto.

To provide for the insertion of the yarn end into the tube as described above, suction in a central suction conduit in the tube plate for drawing the yarn end thereinto is combined with the suction means being reversible to blow the drawn-in yarn end from the tube plate into the tube, which blowing is facilitated by the other tube plate having a central bore through which air escapes.

In the preferred embodiment the apparatus is in the form of a traveling service unit movable from one winding station to another of a textile winder and on which unit the aforementioned winding components are mounted. In addition, means are provided for transferring tubes from a supply to the tube plate for clamping and from the tube plate to a position at a winding station for cross-winding of yarn on the tube following forming of the reverse windings. Thus, a totally automatic reserve winding formation is provided for operation at winding stations as needed.

Further features and advantages of the present invention will be apparent from the accompanying drawings and following detailed description.

DETAILED DESCRIPTION OF THE PREFERRED EMBODIMENT

Figure 1:
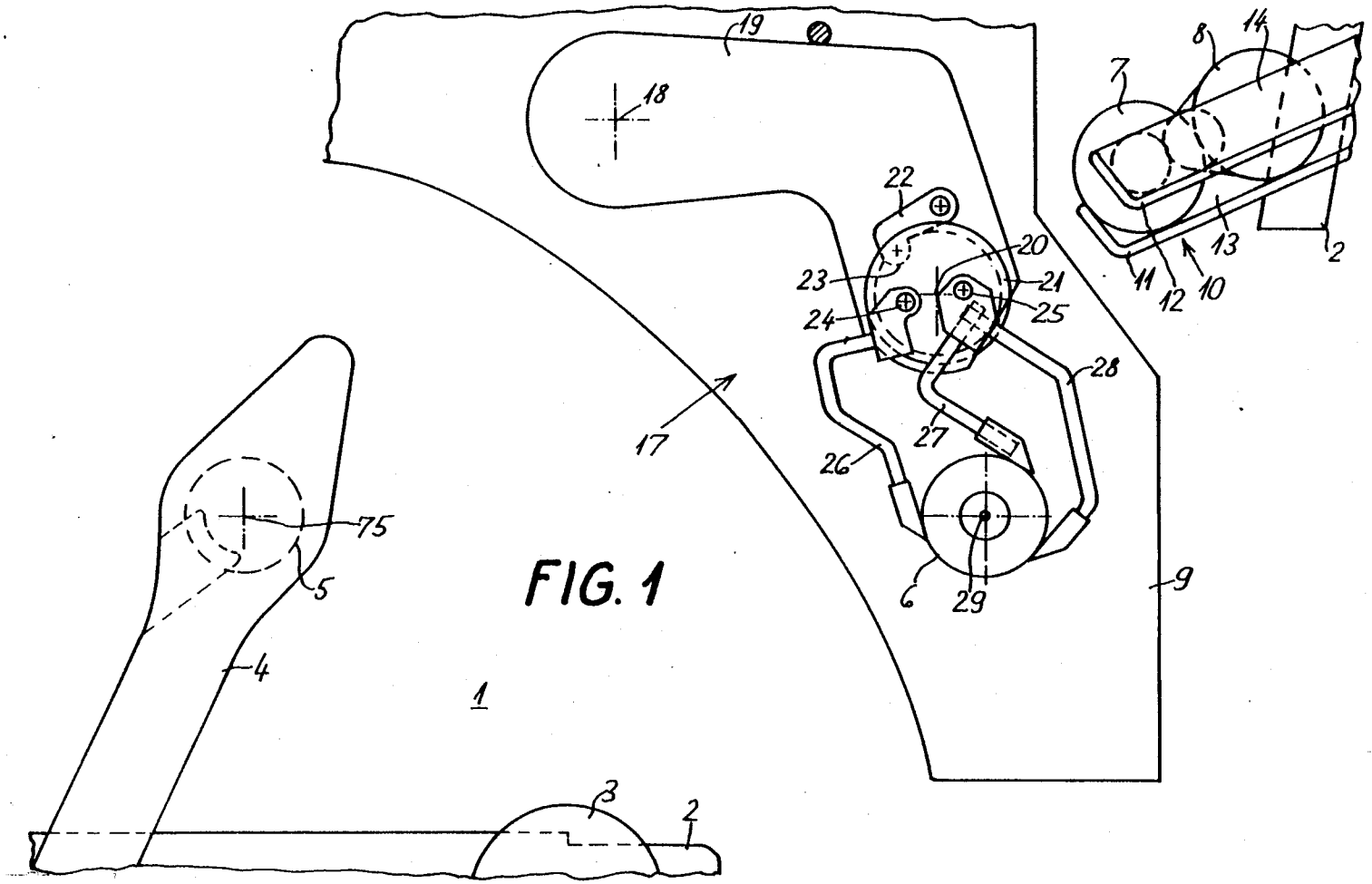
FIG. 1 is a side elevation of portions of a winding station of a textile winder with portions of a service unit that is located thereat, including components of the preferred embodiment of the apparatus of the present invention mounted thereon.

FIG. 1 illustrates a winding station 1 of an automatic winder on which cross-wound packages are built at a plurality of winding stations aligned in the direction of the view in FIG. 1. The winder includes a frame 2 at the spooling station 1, which frame carries, among other things, a grooved drum 3 for driving the tube as the package is being built and a pivoted creel 4 in which a tube is clamped between rotatable tube plates 5 during building of a package. FIG. 1 illustrates the creel 4 in an upwardly pivoted position prior to receipt of a tube and illustrates a tube 6 located in a traveling service unit 9 with two other tubes 7,8 providing a supply in a tube magazine 10 at the winding station 1. The tubes illustrated are conical for building conical cross-wound packages. The tube magazine 10 includes two runners 11,12 on which the tubes are support and sidewalls 13,14 for retaining the tubes in position.

The service unit 9 is an automatic package removing and tube inserting device that removes built packages from the creel 4 and places tubes having reserve windings 15 of yarn (FIG. 6), e.g. tube 6, in the creel 4, which then clamps the tube between the tube plates 5 and positions it into contact with the rotatable grooved drum 3. The reserve windings 15 of yarn are formed from yarn 16 (FIG. 6) supplied from a source, such as a delivery bobbin (not shown) so that after the tube 6 has been clamped into the creel 4 and after friction contact has been established between the grooved drum 3 and the tube 6, the building of the cross-wound package can begin.

Figure 2:
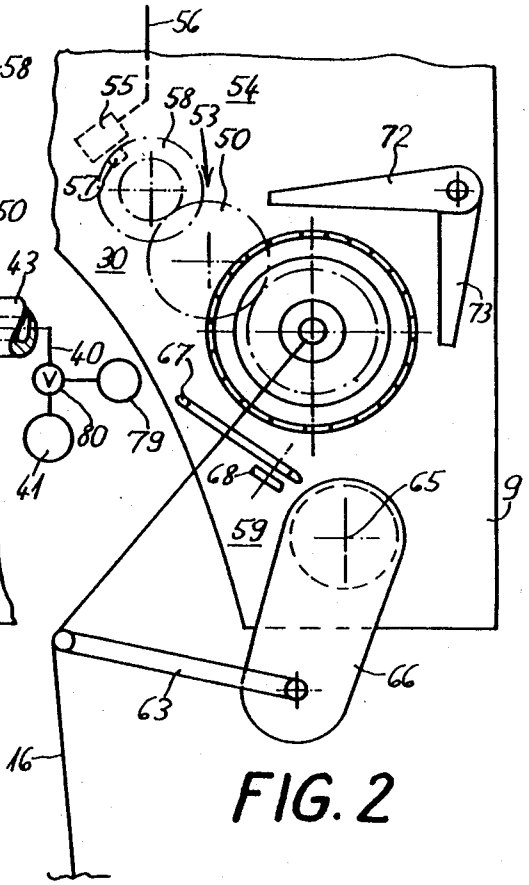
FIG. 2 is a side elevation of the service unit showing additional components of the apparatus of FIG. 1.

The service unit 9 illustrated in FIG. 1 includes, among other things, means 17 for transferring tubes from the supply of tubes in the magazine to tube plates 33,34 for clamping and from the tube plates to a position at the winding station 1 for cross-winding of yarn on the tube following forming of the reserve windings 15 thereon. The transferring means 17 includes an arm 19 pivotally mounted about a pivot axis 18 on the unit 9. The arm 19 carries a head 21 rotatable about an axis 20 and releasably retained against rotation by a pivoted detent 22 on the arm 19 engageable in a notch 23 in the head 21. Mounted on the head 21 are two rotatable shafts 24,25 mounted for rotation in opposite directions. One of the shafts 24 carries a gripping finger 26 and the other shaft 25 carries two gripping fingers 27,28, with the gripping fingers serving to engage and hold a tube. As illustrated in FIG. 1, the fingers 26,27 and 28 have removed a tube 6 from the magazine 10 and transferred it into axial alignment with a longitudinal axis 29 of a reserve winding device 30 (FIGS. 2 and 3).

Figure 3:
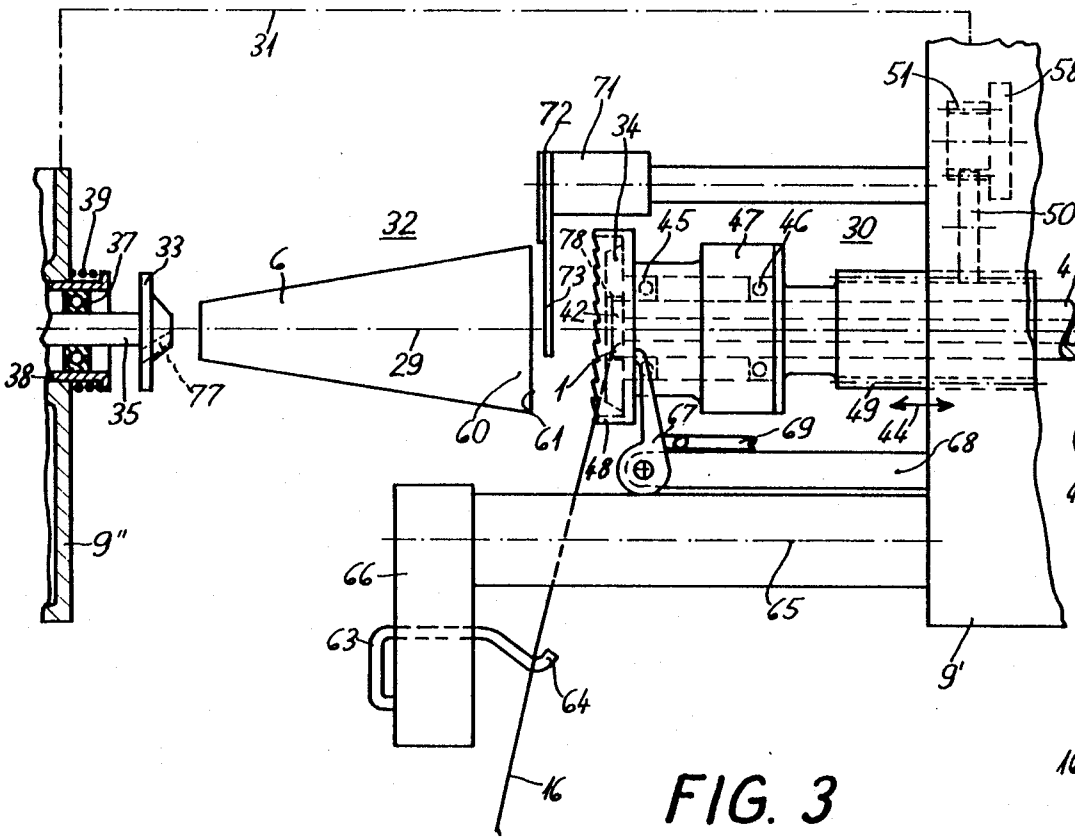
FIG. 3 is a front elevation of the apparatus of FIG. 1.

FIG. 3 illustrates the service unit 9 having a frame 9',9'' that spans the reserve winding device 30 as indicated diagrammatically by the dotted line 31. The full extent of the frame is not illustrated because of its size in relation to the components illustrated in the figures. The service unit 9 is moved in a known manner on rails (not illustrated).

Figure 5:
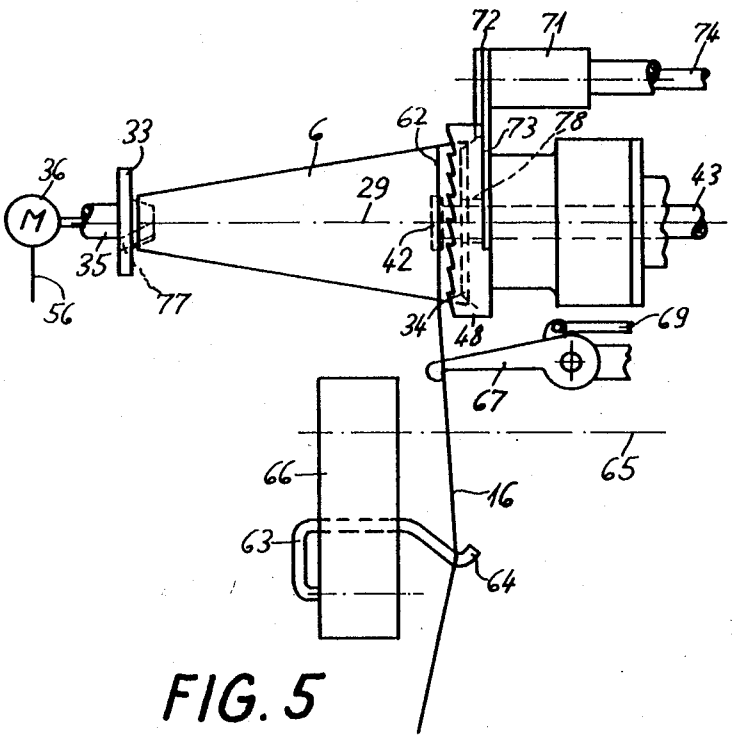
FIG. 5 is a front elevation of the apparatus of FIG. 4.

The reserve winding device 30 includes means 32 for rotating the tube 6, which includes the aforementioned two rotatably mounted tube plates 33,34 that are mounted for shifting of at least one of the plates 34 longitudinally relative to the other plate 33 to serve as means for clamping a tube therebetween and to allow subsequent unclamping of the tube. One tube plate 33 includes an air passage bore 77 opening into the atmosphere and into the interior of the tube. This plate 33 is located on the end of a shaft 35 that is connected, as illustrated in FIG. 5, to a drive mechanism 36 in the form of an electric geared motor. The shaft 35 is mounted in ball bearings 37 in a longitudinally shiftable housing 38 that is biased by a coil spring 39 in a clamping direction toward the tube and is shiftable in the frame 9'' of the service unit 9 away from the tube to allow removal thereof.

The tube plate 34 is formed with a central bore 78 in which a central suction conduit 43 is mounted. The conduit 43 is connected by flexible tubing to a valve 80 that can be selectively manipulated from a closed position to either a source 41 of suction or a soruce 79 of compressed air. When the valve 80 is manipulated to communicate with the suction source 41, the suction and the suction conduit 43 provide means for drawing in the end of the yarn 16 from a supply bobbin at the winding station 1. For this purpose, the suction conduit 43 is mounted for shifting longitudinally in the direction of the double arrow 44 in the frame 9'and has a vacuum intake opening 42 directed toward the interior of the tube centrally of the tube plate 34. When the valve 80 communicates with the source 79 of compressed air, the compressed air and the conduit serve as means for blowing the drawn-in end 76 of yarn into the interior of the tube, as shown in dot-dash lines in FIG. 6. Such blowing can occur either during forming of the reserve windings or after the completion thereof.

The suction conduit 43 carries a rotatable tube receiving sleeve 47 on two ball bearings 45,46. The sleeve 47 is connected at one end to the tube plate 34 and a toothed collar 48 that extends around the periphery of the tube plate 34. At its other end, the sleeve 47 is in the form of a pinion 49, that engages a gear 50 of gearing 53 that is associated with means for counting in the form of a winding counter 54. The counter 54 includes an impulse sensor 55 that can be set to a preselected number of impulses. The sensor 55 is responsive to a magnet 57 embedded in a disk 58 that is mounted on a gear 51 of the gearing 53 for rotation in response to rotation of the tube. The impulses are proportional to the desired number of windings of the reserve winding. There is an operative connection 56 from the impulse sensor 55 to the tube drive motor 36 so that the counting device serves not only as means for counting but also for controlling the rotation of the tube to form the reserve winding.

The service unit 9 also carries automatic yarn guiding means 59 that includes a guide element 63 that guides supply yarn 16, as illustrated in FIG. 5, from the end 61 of a clamped tube 6 inwardly along the surface of the tube to provide an initial length of yarn extending from the drawn-in end thereof. This initial length can extend in a straight line, a helical line or a spatial spiral, depending on the particular shape of the tube being wound. The guide element 63 is in the form of a guide wire that is provided with a recess 64. The wire 63 is mounted in a lever arm 66 pivotable about an axis 65.

Means 67 for advancing the yarn from the inward extent of the initial length toward the tube end is in the form of a hook pivotally mounted on a rod 68, with the hook being pivotally manipulated by an operating rod 69. This advancing means 67 engages the yarn 16 as the tube is rotated so that rotation of the tube and advancing of the yarn will begin with a first winding 62 toward the tube edge 61 over the initial length to form a plurality of substantially non-overlapping windings overlaying the initial length and slightly spaced apart from each other.

The apparatus also includes means 71 for cutting excess yarn from the drawn-in end 70 thereof. This cutting means 71 includes a pair of knife blades 72,73 controlled by a shaft 74 in the manner of conventional scissors that are not illustrated in detail. The excess yarn length 70' is cut from the yarn end 70 by the cutting means 71 and is drawn off through the suction tube 43.

The operation of the apparatus to form a reserve winding on the end portion 60 of a tube 6 adjacent the tube end 61 will now be described.

First, the service unit 9 travels to a winding station 1 and becomes engaged thereat. It then functions to raise the creel 4 by conventional means, not shown, to remove a built package and position the creel 4 in raised position away from the grooved drum 3. Thereafter, the arm 19 of the tube transferring means 17 pivots clockwise about pivot axis 18 and head 21 is rotated counterclockwise. The fingers 26,27 and 28 are opened by opposite rotation of the shafts 24,25 in readiness for engaging a tube in magazine 10. The fingers are then closed about the tube and the head 21 rotated to align the gripped tube with the longitudinal axis 29 indicated in FIG. 1.

The valve 80 is then manipulated to communicate with the source 41 of suction and an end of yarn from a supply bobbin is presented by conventional means to the vacuum intake opening 42 of the suction conduit 43, through which it is drawn and retained as illustrated in FIG. 3. At this point, the cutting means 71 is open and the automatic yarn guiding means 59 has not yet begun operation.

Next, the suction conduit 43 is shifted to the left along the double arrow 44 of FIG. 3 so that the tube plate 34 clamps against the end 61 of the tube, thereby clamping the yarn 16 between the tube end 61 and the tube plate 34. The fingers 26,27 and 28 of the tube transferring means 17 continue to hold the tube 6. The left end of the tube 6 is clamped against the other tube plate 33 by further advance of the suction conduit 43 to the left whereby the bearing housing 38 yields somewhat against the force of the pressure spring 39, resulting in the tube 6 being clamped between the plates 33 and 34.

Figure 4:
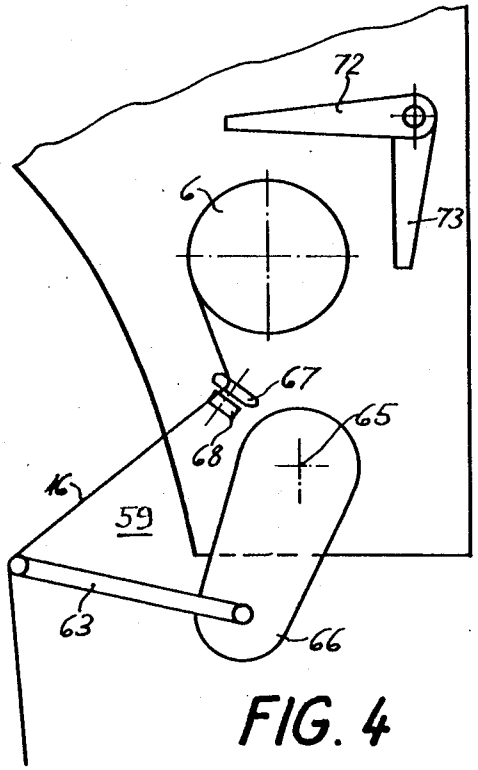
FIG. 4 is a view similar to FIG. 2 showing some of the components of the apparatus in position for forming reserve windings.

Then, the automatic yarn guiding means 59 is actuated by clockwise pivoting (FIG. 2) of the arm 66 about pivot axis 65 to cause the guide wire 63 to engage the yarn 16 and guide it to provide the initial length of yarn extending inwardly from the end of the tube in preparation for winding of yarn therearound. Simultaneously, the advancing means is brought into initial position by shifting the manipulating rod 69 to the left (FIG. 5). As seen in FIG. 4, the yarn 16 now follows a path that is controlled by the wire 63 and the hook 67. The toothed collar 48 retains the yarn end in proper position over the tube end 61 during clamping, guiding and advancing the yarn.

Figure 6:
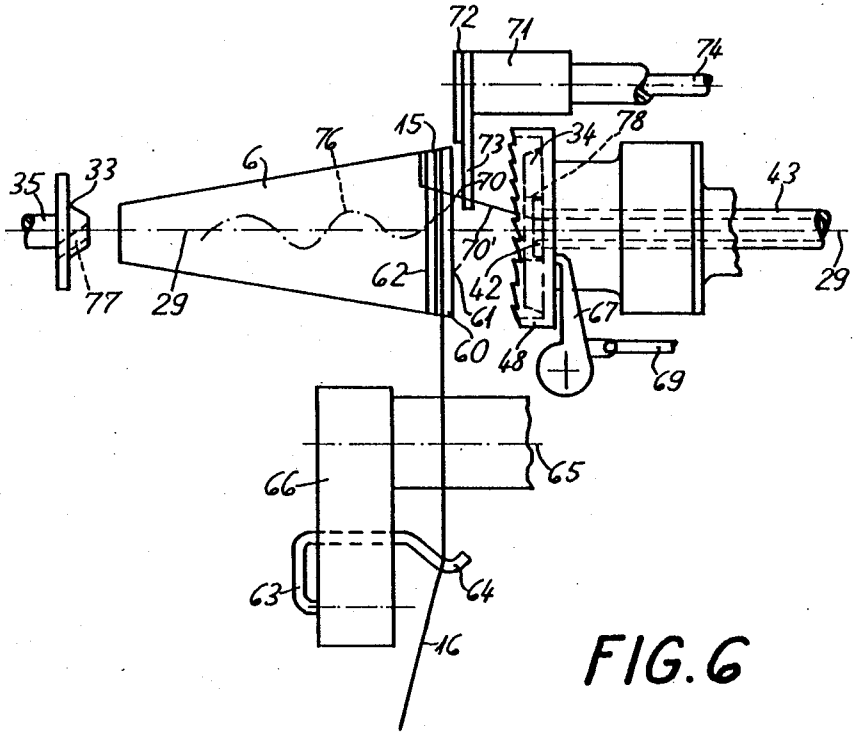
FIG. 6 is a view similar to FIG. 5 showing the apparatus after formation of the plurality of reserve windings.

The drive motor 36 now begins rotation of the tube, which has previously been released by the fingers 26,27 and 28. Rotation of the tube and manipulation of the guide wire 63 and hook 67, moving in a controlled manner to the right (FIG. 5), causes the yarn to form reserve windings 15 beginning with a first inward winding 62 and progressing, without overlapping and with a spacing between windings, toward the end 61 of the tube. FIG. 6 illustrates a completed reserve winding 15 of only a few windings, which is for illustrative purposes only; in practice, considerably more windings may be applied as desired, but it is intended that the overlapping of windings be avoided to the greatest extent practically possible.

As the tube 6 is rotated to form the reserve windings, the gearing 53 of the couner 54 is driven in response to rotation of the tube. This gearing is responsive to rotation, not the angular velocity or angular rotation of the tube, so that the reserve windings are wound in a parallel pattern.

As soon as the counter has counted a preselected number of impulses by the sensor 55, the drive motor 36 is stopped to stop the tube 6.

The sensing of the selected number of windings also provides a signal to an automatic control device (not illustrated) of the service unit 9 to initiate operation of a cam disk mechanism of conventional construction (not illustrated) that activates closing of the fingers 26,27 and 28 on the tube 6, following which the suction conduit 43 is withdrawn to the right to separate the plates 33,34 to free the tube as illustrated in FIG. 6. The cutting means 71 is then activated to cut the excess yarn 70', leaving only a desired short yarn end 70 of a maximum length of approximately one centimeter extending from the reserve windings. In the meantime, the guiding means and advancing means are returned to their starting positions by manipulation of the rod 69 and the arm 66.

By the foregoing operation the reserve winding has been completed. The cam disk mechanism now functions to manipulate the tube transferring means 17 by pivoting the arm 19 clockwise about axis 18 so that the longitudinal axis 29 of the tube 16 now coincides with the winding axis 75 of the creel between the plates 5, which now close to clamp the tube 6 in position. The creel 4 is then lowered under the control of the cam disk mechanism so that the tube 6 is in rotatable engagement with the grooved drum 13 for start-up of the cross-winding building of the package. Before the winding begins, the fingers 26,27 and 28 are manipulated to release the tube 6 and the arm 19 pivots back into the position shown in FIG. 1 in readiness for the servicing unit to travel to another winding station as desired where its functioning may be needed.

If a long yarn end, rather than a short end, is required, the cutting means 71 can be placed out of operation and the impulse sensor 55 can activate manipulation of the valve 80 to communicate with the compressed air source 79 when the drive mechanism 36 is out of operation. The compressed air will then blow through the suction conduit 43 to blow the end portion 76 of yarn from the conduit 43 into the interior of the tube 6, with the compressed air escaping through the other end of the tube and the bore 77 in the other tube plate 33. For this purpose, at least a few centimeters of yarn are initially drawn into the suction tube 43 for subsequent inserting by the aforementioned blowing into the interior of the tube. This initial drawing-in of at least a few centimeters of yarn also serves the purpose of providing sufficient yarn for clamping whether the yarn end is subsequently blown into the interior of the tube or is cut to a desired length by the cutting means.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of forming a reserve winding of yarn on a tube on which yarn is to be cross-wound to build a bobbin comprising drawing at least a few centimeters of yarn centrally into a rotatable tube plate, clamping the end of a tube against the tube plate with the yarn clamped therebetween, guiding the yarn inwardly from the clamped tube end along the surface of the tube to form an initial length of yarn, and rotating the tube and advancing the yarn toward the tube end to form a plurality of substantially non-overlapping windings progressing toward the tube end and overlaying said initial length of yarn.

2. A method of forming a reserve winding of yarn on a tube according to claim 1 and characterized further in that said drawing of yarn is performed by suction in a central suction conduit in said tube plate.

3. A method of forming a reserve winding of yarn on a tube according to claim 1 and characterized further by cutting the drawn-in yarn after the plurality of windings is formed to provide a maximum length of yarn of approximately one centimeter extending from the plurality of windings.

4. A method of forming a reserve winding of yarn on a tube according to claim 3 and characterized further by unclamping the tube from the tube plate prior to said cutting.

5. A method of forming a reserve winding of yarn on a tube according to claim 1 and characterized further by inserting the drawn-in yarn into the interior of the tube.

6. A method of forming a reserve winding of yarn on a tube according to claim 5 and characterized further in that said drawing of yarn is performed by suction in a central suction conduit in said tube plate and said inserting is performed by blowing through the suction conduit into the interior of the tube.

7. Apparatus for forming a reserve winding of yarn on a tube on which yarn is to be cross-wound to build a bobbin comprising a rotatable tube plate, means for drawing yarn centrally into said tube plate, means for clamping the end of a tube against said tube plate with the yarn clamped therebetween, means for guiding the yarn inwardly from said clamped tube end along the surface of the tube to form an initial length of yarn, means for rotating the tube and said tube plate, and means for advancing the yarn toward the tube end to form a plurality of substantially nonoverlapping windings progressing toward the tube end and overlaying said initial length of yarn.

8. Apparatus for forming a reserve winding according to claim 7 and characterized further by an other tube plate and said clamping means comprises means for shifting at least one of said tube plates relative to the other tube plate for clamping of the tube therebetween.

9. Apparatus for forming a reserve winding according to claim 8 and characterized further by a tube connecting said central suction conduit with a valve, said valve being selectively manipulable to communicate said central suction conduit with a suction creating means for drawing the yarn into said tube plate and to communicate said central suction conduit with a compressed air means for blowing the drawn-in yarn end into the tube.

10. Apparatus for forming a reserve winding according to claim 7 and characterized further by means for counting the rotation of said tube by said rotating means and controlling said rotating means in response to counting.

11. Apparatus for forming a reserve winding according to claim 7 and characterized further by means for cutting the drawn-in yarn to provide a maximum length of approximately one centimeter extending from the plurality of windings.

12. Apparatus for forming a reserve winding according to claim 7 and characterized further in that said drawing means comprises a central suction conduit in said tube plate and means for creating suction in said conduit.

13. Apparatus for forming a reserve winding according to claim 7 and characterized further in that said apparatus is in the form of a traveling service unit movable from one winding station to another of a textile winder and on which unit said tube plate, said drawing means, said clamping means said guiding means, said rotating means and said advancing means are mounted, and by means for transferring tubes from a supply to said tube plate for clamping and from said tube plate to a position at a winding station for cross-winding of yarn on the tube following forming of reserve winding thereon.

* * * * *